US006415517B1

(12) United States Patent
Worrick, III

(10) Patent No.: US 6,415,517 B1
(45) Date of Patent: Jul. 9, 2002

(54) STORAGE DEVICE FOR SHAVING RAZOR, CARTRIDGES, OR OTHER STORED ITEMS

(75) Inventor: Charles Bridgham Worrick, III, Hanson, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 09/364,240

(22) Filed: Jul. 29, 1999

(51) Int. Cl.[7] ..... B26B 21/40

(52) U.S. Cl. ..... 30/541; 30/537; 206/208; 206/228; D9/342

(58) Field of Search ..... 30/537, 541, 40; 206/470, 471, 228, 208, 223, 352, 353; 211/87.01; D9/342, 345; 221/100, 123, 154

(56) References Cited

U.S. PATENT DOCUMENTS

| | | | | |
|---|---|---|---|---|
| 1,536,468 A | * | 5/1925 | Behrman | 30/541 |
| 1,912,531 A | | 6/1933 | Lawson | |
| 1,996,405 A | * | 4/1935 | Chadwick | 30/541 |
| 2,432,818 A | | 12/1947 | Schults | |
| 2,883,062 A | | 4/1959 | Rosemark | |
| 3,366,268 A | | 1/1968 | Struck | |
| D216,635 S | | 2/1970 | Grange | D9/186 |
| 3,754,326 A | | 8/1973 | Glaberson | 30/40 |
| 3,822,781 A | | 7/1974 | Braginetz | 206/45.14 |
| 3,869,183 A | | 3/1975 | Frank, Jr. | 312/248 |
| D237,666 S | | 11/1975 | Iten | D6/88 |
| 3,970,194 A | | 7/1976 | Iten | 206/228 |
| 4,019,793 A | | 4/1977 | Gerding | 312/209 |
| D251,896 S | | 5/1979 | Nissen | D9/192 |
| D253,167 S | * | 10/1979 | Fournier et al. | D9/342 |
| 4,450,980 A | | 5/1984 | Clabby et al. | 221/281 |
| 4,611,716 A | | 9/1986 | Sorlien | 206/581 |
| 4,742,909 A | | 5/1988 | Apprille, Jr. et al. | 206/356 |
| D313,175 S | | 12/1990 | Motta et al. | D9/342 |
| D316,962 S | | 5/1991 | Gray | D9/342 |
| D320,342 S | | 10/1991 | Gray | D9/342 |
| 5,113,586 A | | 5/1992 | Lazarchik et al. | 30/90 |
| D335,413 S | | 5/1993 | Lizanetz et al. | D6/526 |
| D335,990 S | | 6/1993 | Lizanetz et al. | D6/526 |
| 5,228,580 A | | 7/1993 | Grange | 211/70.6 |
| 5,242,063 A | | 9/1993 | Ericksen et al. | 211/87 |
| 5,265,759 A | | 11/1993 | Coffin | |
| 5,407,066 A | | 4/1995 | Grange | 206/228 |
| 5,429,241 A | | 7/1995 | Althaus | 206/471 |
| D364,060 S | | 11/1995 | Lai | D6/526 |
| 5,518,114 A | | 5/1996 | Kohring et al. | 206/352 |
| D370,375 S | | 6/1996 | Murgida et al. | D6/526 |
| 5,623,955 A | | 4/1997 | Sewell | 132/291 |
| 5,738,020 A | | 4/1998 | Correia | 109/51 |
| 5,782,346 A | | 7/1998 | Gray et al. | 206/228 |
| 5,839,198 A | * | 11/1998 | McCoy | 30/537 |
| 5,862,816 A | * | 1/1999 | Lowe | 30/541 |
| 5,903,978 A | | 5/1999 | Prochaska et al. | 30/34.05 |

FOREIGN PATENT DOCUMENTS

| | | |
|---|---|---|
| EP | 0 290 965 | 11/1988 |
| FR | 2491877 | 4/1982 |
| GB | 2 107 175 A | 4/1983 |

OTHER PUBLICATIONS

Annex to Form PCT/ISA/206, PCT/US 00/20068.

* cited by examiner

*Primary Examiner*—Hwei-Siu Payer
(74) *Attorney, Agent, or Firm*—Fish & Richardson P.C.

(57) ABSTRACT

A storage device, e.g., for a shaving razor and replacement cartridges, including a base member having at least one storage compartment, and one or more sealed packages that are each located in a respective storage compartment. The sealed package contains a shaving cartridge including a plastic housing and a plurality of blades. Each compartment provides a retention force, e.g., by opposed members, to retain a respective package within the compartment with a retention force that is less than a peeling force needed to initiate peeling of a cover layer sealably connected to the stored package. The cover has shaving razor engagement structure for carrying a razor on an external surface of the cover.

57 Claims, 8 Drawing Sheets

STORAGE DEVICE FOR SHAVING RAZOR, CARTRIDGES, OR OTHER STORED ITEMS

This application is related to an application entitled "Container for Storing Shaving Cartridges or Other Stored Items," U.S. Ser. No. 09/364,242, filed concurrently herewith, which is hereby incorporated by reference.

BACKGROUND OF THE INVENTION

The invention relates to storage devices for storing items such as shaving razors and cartridges.

Shaving cartridges are typically sold in plastic dispensers containing a plurality of shaving cartridges in respective sections of the dispenser. Shaving razors are often sold supported on a plastic tray that can then be used to support the razor in a bathroom. Some plastic trays are designed to carry a dispenser of razor blades on the bottom side of the tray.

SUMMARY OF THE INVENTION

In one aspect, the invention features, in general, a shaving cartridge storage device including a base member having at least one storage compartment, and one or more sealed packages that are each located in a respective storage compartment. Each sealed package contains a shaving cartridge including a plastic housing and a plurality of blades.

In some other aspects, the invention features, in general, a sealed package storage device including a base member having at least one storage compartment, and one or more sealed packages that are each located in a respective storage compartment and contain a respective stored unit therein. Each compartment provides a retention force to retain a respective package within the compartment. In some aspects the compartment has opposed members to provide the retention force to opposite sides of a package. In some other aspects each package has an opening that has been sealed with a peelable film at a sealing surface surrounding the opening. The film is peelable from the sealing surface upon the application of a peeling force that is greater than the retention force that holds the sealed package in the storage device compartment.

Preferred embodiments of the invention may include one or more of the following features. In preferred embodiments, the base member of the storage device can carry a surface-mounting structure, for a horizontal surface or a wall, such as double-sided adhesive tape, suction cups, or openings in the base member for receiving transverse mounting members attached to a wall. The base member is formed of plastic and has a side wall that extends around its periphery. The base member has dividers formed therein to provide a plurality of compartments along with the side wall. The dividers each have a flat portion at a free end of the divider, the flat portion receiving a lip that extends from one side of the package retained in the compartment. The dividers each also have a ridge that is formed between the base and the free end for receiving a narrow edge portion of the package. The dividers extend only part way from the side wall at one side of the base member to the side wall at the other side to provide a region for gripping an exposed portion of the lip of the package. The dividers have opposed members for retaining the packages. One of the opposed members has a sharp portion that engages the package. One of the opposed members can have spring flexure. The dividers have drainage openings, and the side wall has a drainage opening at the bottom of the base member. The base member has projections between the dividers to position the packages.

In another aspect, the invention features, in general, a storage device for sealed packages that includes a base member having at least one storage compartment, one or more sealed packages that are each located in a respective storage compartment, and a cover that is hingedly connected to the base member.

In another aspect, the invention features, in general, a storage device for a shaving razor. The storage device includes a base member having at least one storage compartment and a cover that is hingedly connected to the base member. The cover has shaving razor engagement structure on an external surface thereof.

Preferred embodiments of the invention may include one or more of the following features. In preferred embodiments, the cover of the base member is hingedly connected to the base member by a snap-fit connection. The cover has an opening that engages the bottom of a razor handle and opposed flexible wings that engage the razor head end of the handle. The cover has a raised portion that matches the contour of one side of a razor handle. The cover has a flat area to provide clearance for the cartridge attached to a handle supported on the cover. The cover is made of softer plastic than the base member. The cover has a snap-fit closure member and a finger engagement lip extending from the cover for opening the cover.

Embodiments of the invention may include one or more of the following advantages. Shaving cartridges packaged in sealed containers, to protect them from water and cleaning agents, are stored in a storage device that can be conveniently mounted on a bathroom shower wall. The sealed packages are securely retained prior to removal, and can be easily gripped at exposed corners. The sealed packages are safely removed from the storage device in normal use without risk of the peelable film being removed prematurely. The shaving razor can be conveniently and securely mounted on the outside of the cover for easy removal and replacement without the need to open the cover. Drainage openings prevent water from collecting in the device.

Other advantages and features of the invention will be apparent from the following detailed description of particular embodiments of the invention and from the claims.

DETAILED DESCRIPTION OF THE INVENTION

Figure 1:
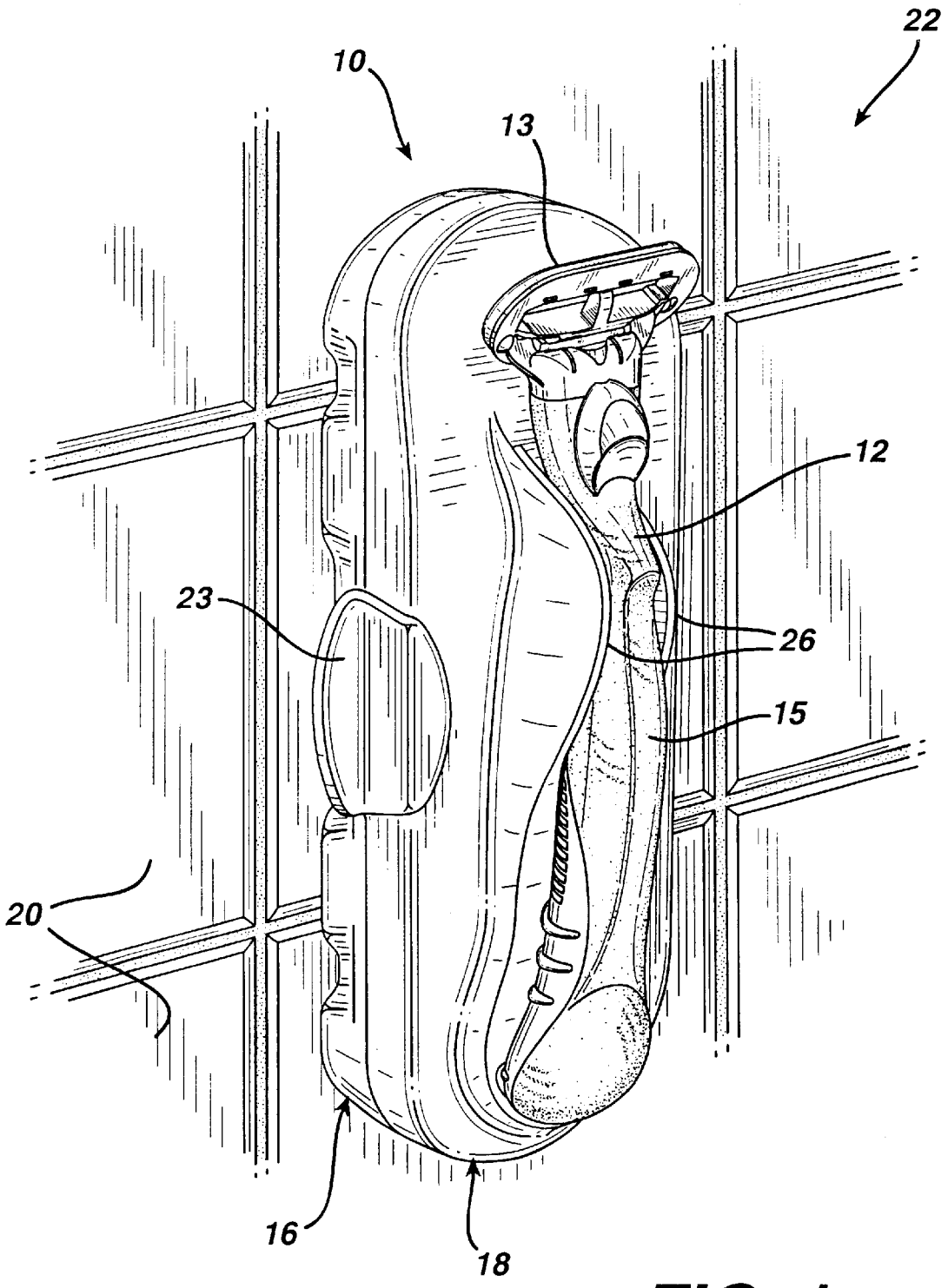
FIG. 1 is a perspective view showing a storage device mounted on a bathroom wall.
Figure 2:
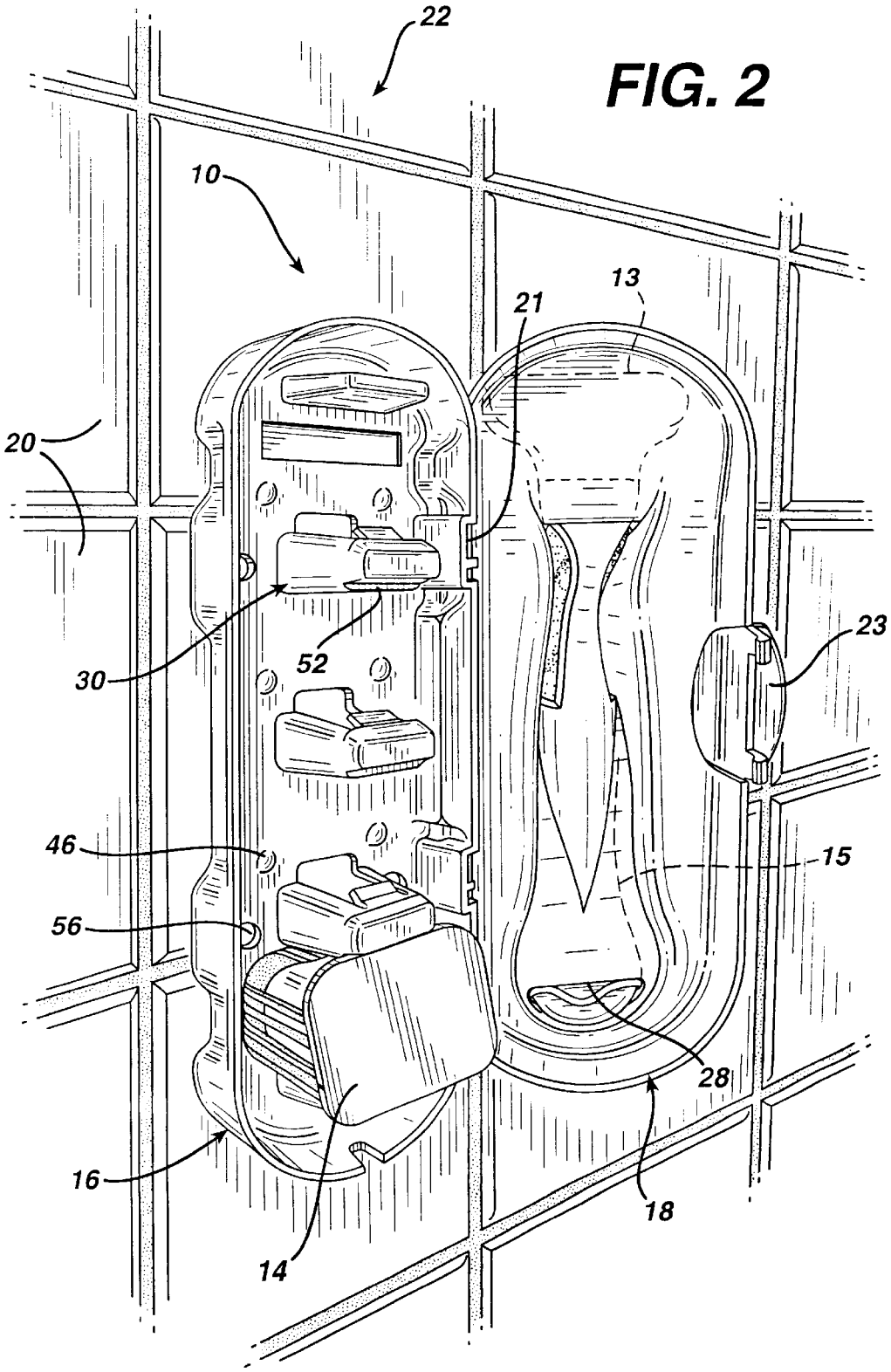
FIG. 2 is a perspective view showing the FIG. 1 storage device in an open position with a single sealed package therein.
Figure 3:
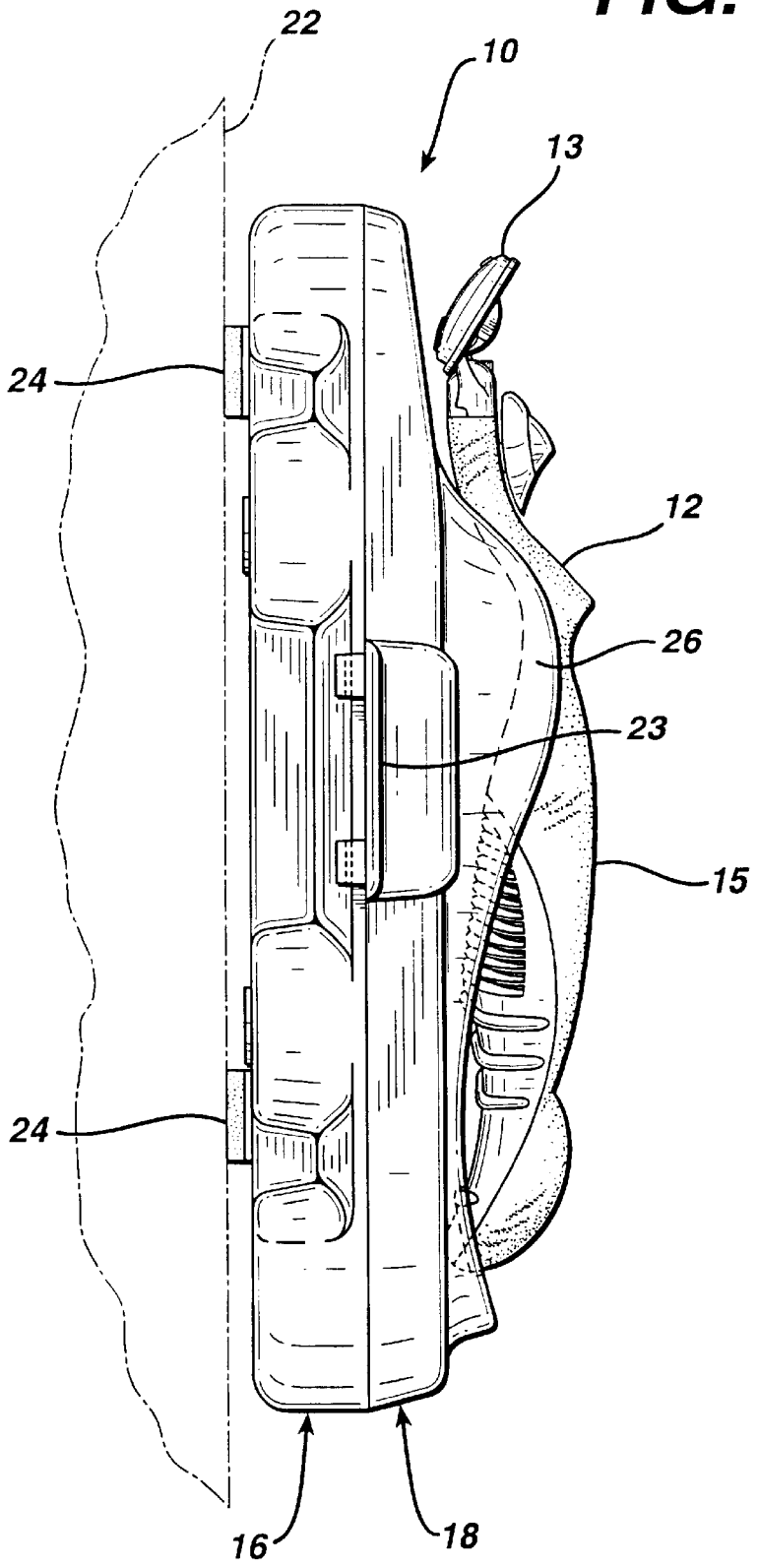
FIG. 3 is a side elevation showing the FIG. 1 device in a closed position.

Referring to FIGS. 1, 2 and 3, there is shown wall-mounted storage device 10 for a shaving razor 12 that is supported on the outside of device 10, and replacement cartridges 13 in a sealed package 14 that is stored inside device 10. Cartridges 13 each have a plastic housing and a plurality of blades. Sealed packages 14 have airtight seals to keep moisture and cleaning agents from cartridges inside the packages. Cartridge 13 is not substantially flat and has a complex, non-planar shape with many different contours. Sealed package 14 sufficiently surrounds those contours and acts as an air and moisture barrier.

Storage device 10 includes base member 16, made of ABS, and cover 18, made of polypropylene. Base member 16 is made of a hard plastic to provide structural integrity for the mounted member. Polypropylene provides a desired appearance for the cover, and facilitates use of a snap-fitting hinge. Base member 16 is adhered to bathroom tiles 20 on wall 22 via double-sided adhesive pads 24 (FIG. 3) made of foam pads and acrylic adhesive. Cover 18 is hingedly connected to base member 16 via snap-fit hinge members 21. Cover 18 has finger engagement lip 23 to assist in opening cover 18 and to provide sufficient force to overcome the snap (interference) fit closure mechanism used to keep cover 18 closed. (Alternatively a latch structure could be employed to keep cover 18 closed.) The upper part of handle 15 of shaving razor 12 is engaged by wings 26 formed on the exterior surface of cover 18, and the bottom of handle 15 sits within opening 28 in cover 18. Razor 12 rests on cover 18.

Figure 4:
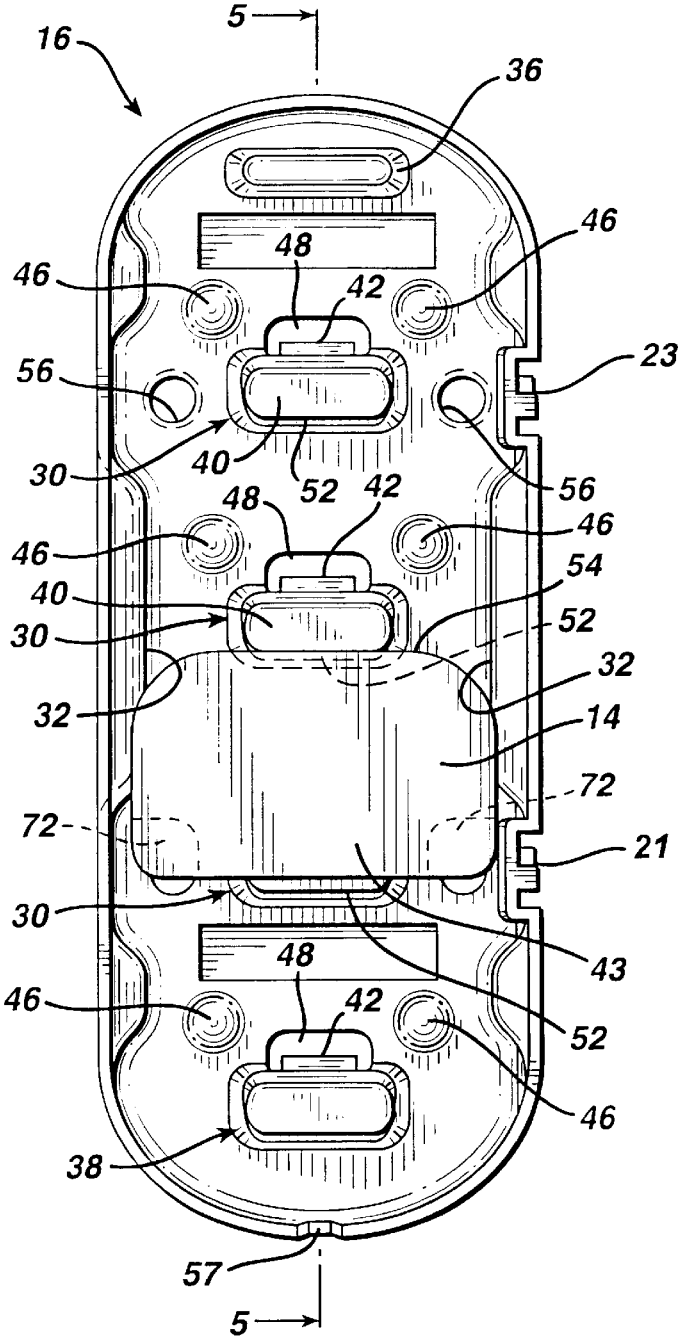
FIG. 4 is a plan view of a base member of the FIG. 1 storage device shown with a single sealed package therein.
Figure 5:
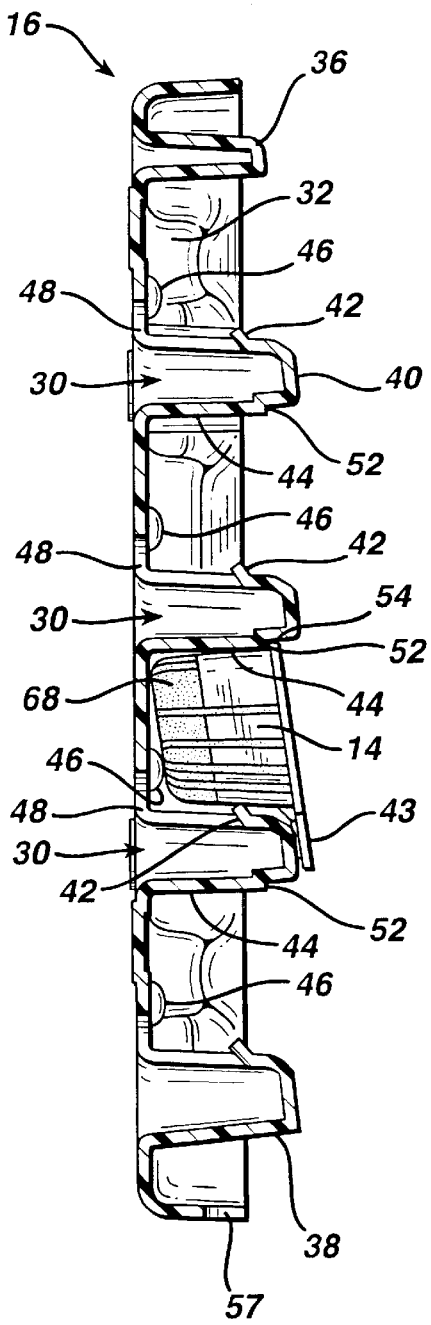
FIG. 5 is the vertical sectional view, taken at 5—5 of FIG. 4, of the FIG. 4 base member and sealed package.
Figure 8:
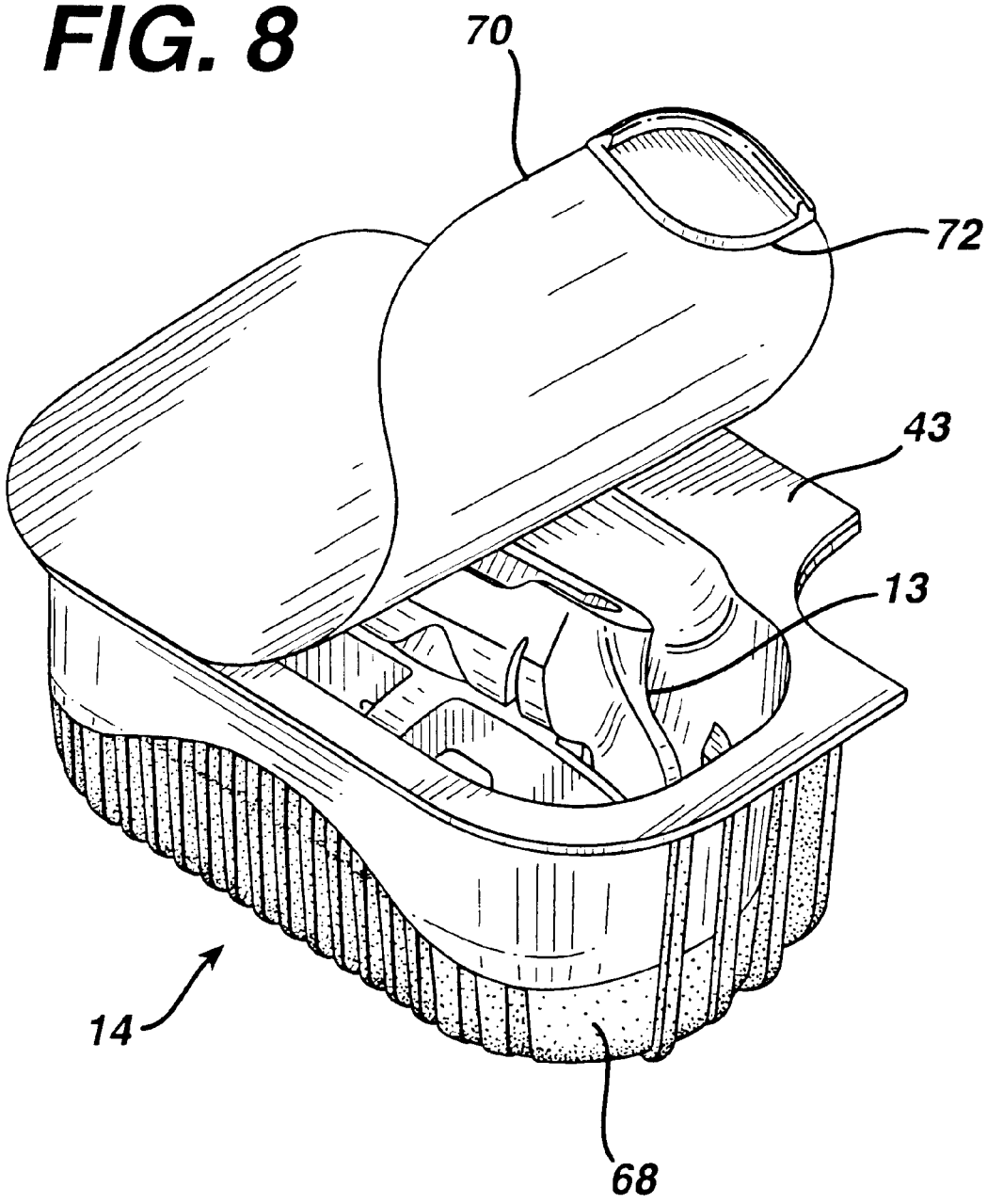
FIG. 8 is a perspective view showing a sealed package of FIGS. 2 and 4 in a partially opened condition.

Referring to FIGS. 4 and 5, it is seen that base member 16 has three dividers 30, which, along with side walls 32 and upper support 36 and lower support 38, define compartments for receiving four sealed packages 14. In FIGS. 4 and 5, a single package 14 is shown in the second compartment from the bottom. Each divider 30 has a flat outer surface 40 at an end thereof against which lip 43 (FIGS. 5 and 8) of package 14 rests. As is seen in FIGS. 4 and 8, the two sides of the lip 43 extend beyond divider 30 or lower support 38 at adjacent plastic tabs 72, providing access for a user to grip and remove package 14. Prior to opening of the packages, tabs 72 in effect are extensions of lip 43. The upper surface of each divider 30 and of lower support 38 has a retention member 42 that presses against the bottom of package 14 and holds it against the opposing flat surface 44 of the next higher divider 30. Retention member 42 advantageously has a sharp edge that digs into the softer plastic of package 14. Retention member 42 and the opposed flat surface 44 function as opposed members that provide a retention force to opposite sides of a package 14 within a compartment. While retention members 42 are hard, they alternatively could be spring-biased. Each compartment also has a pair of projections 46 which space the bottom of the package 14 away from the wall in the desired position (FIG. 5). The upper portion of each divider 30 and lower support 38 has an opening 48 for drainage of water. Flat surface 44 has a ridge 52 at its outer end that receives an edge 54 of sealed package 14 (FIG. 5). Base member 16 also has four through-holes 56 to permit mounting on pins extending from a mounted base plate or to permit mounting by screws or other fasteners. Base member 16 has drainage opening 57 at the bottom.

Figure 6:
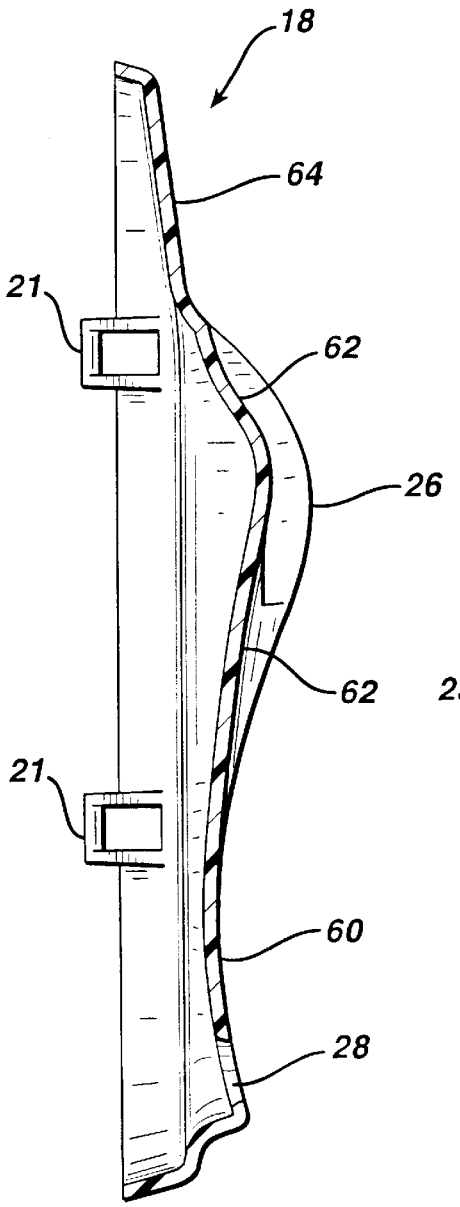
FIG. 6 is a vertical sectional view, taken at 6—6 of FIG. 7, showing a cover of the FIG. 1 storage device.
Figure 7:
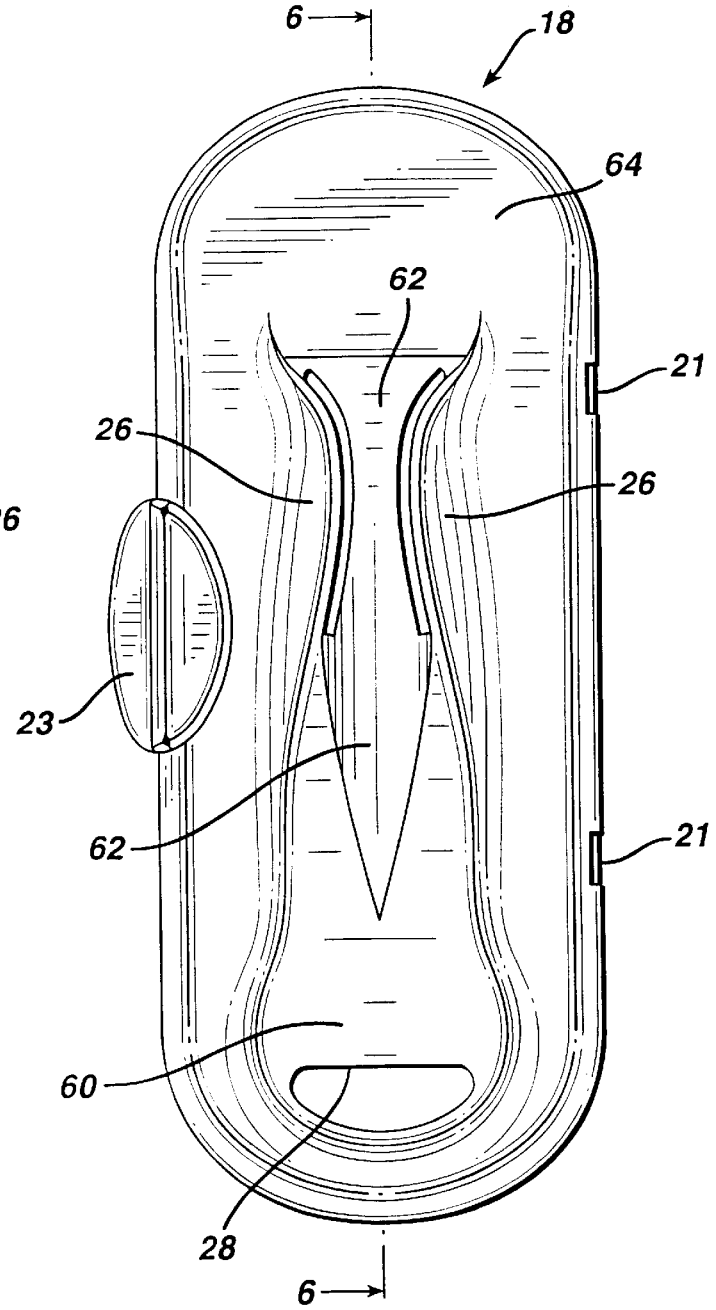
FIG. 7 is a plan view of the FIG. 6 cover.

Referring to FIGS. 6 and 7, cover 18 has support surfaces 60, 62 that tend to conform to the back surface of razor handle 15, which is designed for use by women in shaving underarms and legs. The handle is shown in U.S. Des. Pat. No. 407,851, which is hereby incorporated by reference. The bottom of handle 15 is engaged in and supported by opening 28, and the upper portion of handle 15 is located in the space between wings 26 and outward of support surface 62 and is engaged by wings 26. A flat portion 64 is provided at the upper end of cover 18 for providing clearance for the blade unit of the attached shaving cartridge 13. The back surface of handle 15 closely matches and is close to the outer surface of cover 18. The user grips the sides of handle 15, as there is insufficient room for a user's fingers to grip the back surface of handle 15.

Referring to FIG. 8, sealed package 14 includes a plastic container 68 and peelable cover sheet 70 that is sealed to container 68 to cover and closes the entrance to the storage region for cartridge 13. Gripping tab 72 is attached to a corner of cover sheet 70 at an end of lip 43 for use in initiating peeling of cover sheet 70.

In use, storage device 10 is secured to bathroom tiles 20 of wall 22 (e.g., in a shower) by removing a cover layer on double sided-adhesive pads 24 and applying pressure to device 10 to cause a good bond between the adhesive and the tile surface. The user removes razor 12 when shaving and can store it on cover 18 between uses. When removing razor 12, handle 15 is grasped on the lateral sides of the razor, is slipped outward through support wings 26, and is raised upward from its rest position in opening 28. When placing shaving razor 12 back on cover 18, the bottom of handle 15 is placed in opening 28, and the upper portion of handle 15 is guided between wings 26 and held in place. When it is time to replace the shaving cartridge 13 on handle 15 with a new cartridge 13, cover 18 is opened by engaging finger grips 23, and a sealed package 14 is removed by engaging the tab 72 adjacent to lip 43. Cover 18 is then closed. The user then peels open cover sheet 70 (see FIG. 8) and attaches the new cartridge 13 to handle 15. Cover sheet 70 is attached to container 68 by a seal that has a predetermined initial peel force value needed to open the package. That value is five times higher (preferably ten times higher) than the retaining force provided by retention members 42 to retain packages 14 in their respective compartments in base member 16. E.g., the initial peel force could be 3–5 pounds, and the retaining force on packages 14 could be as little as one ounce. Thus, packages 14 will not accidentally open upon (or prior to) removal from base member 16.

Figure 12:
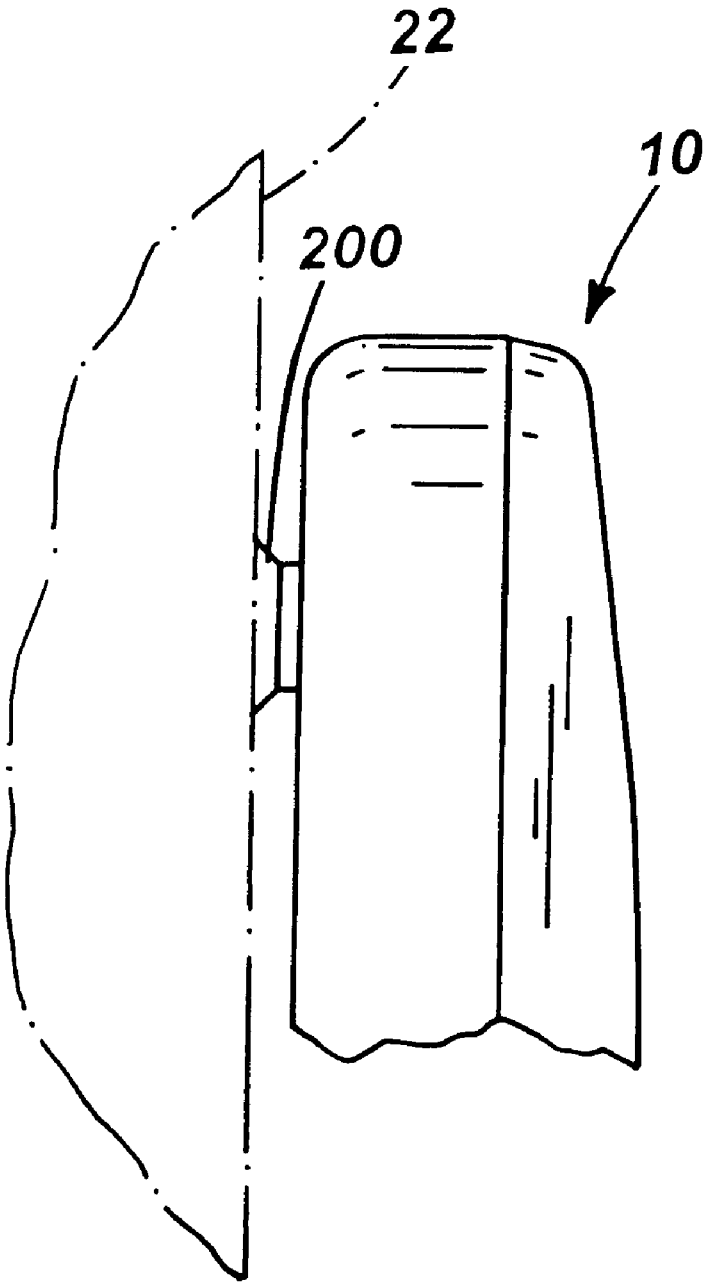
FIG. 12 is a partial side view showing an alternative attachment mechanism for the FIG. 1 device.

Other embodiments of the invention are within the scope of the claims. For example, device 10 could be connected to wall 22 via suction cups 200 (FIG. 12) instead of adhesive pads 24. Also, storage device 10 could be mounted (or simply supported) in a horizontal position on a horizontal surface, and could also be used as a carrying case.

Figure 11:
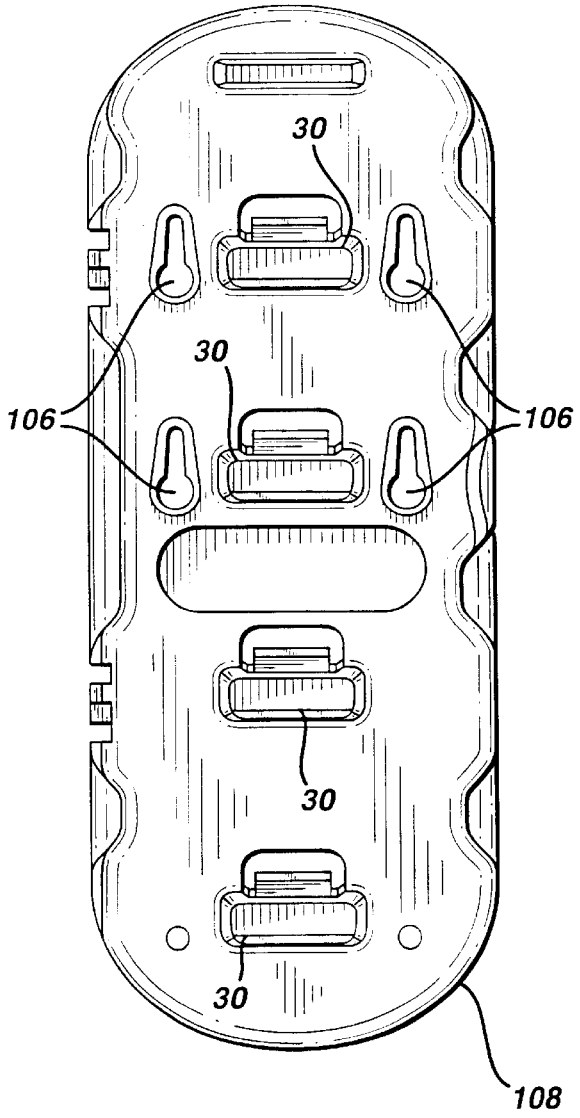
FIG. 11 is a plan view of the alternative base member that is mounted on the FIG. 9 mounting plate.
Figure 9:
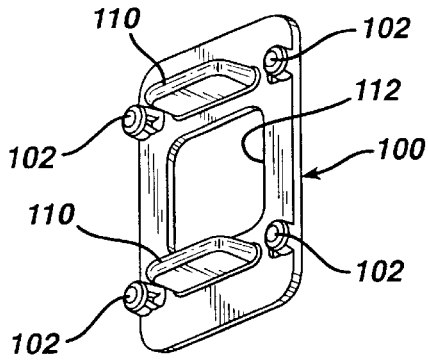
FIG. 9 is a perspective view of a mounting plate for an alternative embodiment of the base member of the storage device.
Figure 10:
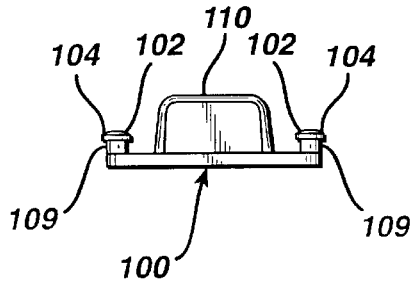
FIG. 10 is an elevation of the FIG. 9 mounting plate.

Also, instead of directly mounting storage device 10 to the wall, it could be removably mounted on a wall-mounted plate, as is shown in FIGS. 9–11. Referring to FIGS. 9–11, plate 100 has posts 102 with enlarged heads 104 that are received in the circular, lower portions of slotted openings 106 on base member 108, the narrow shafts 109 of posts 102 are locked in place in the tapered, upper portions of slotted openings 106. Tapered blade projections 110 on plate 100 fit within recesses on the back sides of the upper two dividers 30 of base member 108 in order to guide openings 106 to the locations of posts 102. Blade projections 110 also prevent base member 108 from being forced downward too far to avoid jamming or breaking of posts 102 during attachment. Plate 100 also has a rectangular opening 112 and is sized so that the plate can be contained within storage device 10 prior to mounting on a wall. When plate 100 is contained in device 10, a divider 30 projects through opening 112.

Listing of Reference Numerals wall-mounted storage device 10
shaving razor 12,
replacement cartridges 13
sealed packages 14
handle 15
base member 16
cover 18
bathroom tiles 20
wall 22
finger engagement lip 23
double-sided adhesive pads 24
flexible wings 26
opening 28
dividers 30
side walls 32
upper support 36
lower support 38
flat outer surface 40
retention member 42
lip 43
flat surface 44
projections 46
opening 48
ridge 52
edge 54
through-holes 56
drainage opening 57
surfaces 60, 62
flat portion 64
plastic container 68
cover sheet 70
gripping tab 72

What is claimed is:

1. A shaving cartridge storage device comprising a base member having at least one divider spaced between respective ends thereof and defining at least one storage compartment, and one or more sealed packages that are each located in a respective storage compartment, each said sealed package containing a replaceable shaving cartridge including a plastic housing and a plurality of blades, said shaving cartridge being enclosed by said sealed package and removable in unitary form from said package.

2. A sealed package storage device comprising a base member having at least one storage compartment, and one or more sealed packages that are each located in a respective storage compartment, each said sealed package having an opening that has been sealed with a peelable film at a sealing surface surrounding said opening, each said sealed package containing a stored unit therein, said film being peelable from said sealing surface upon the application of a peeling force greater than a predetermined peel force value, each said compartment providing a retention force to retain a respective said package within said compartment, said retention force being less than said predetermined peel force value.

3. A storage device for one or more sealed packages comprising a base member having at least one divider spaced between respective ends thereof and defining at least one storage compartment, one or more sealed packages that are each located in a respective storage compartment, each said package containing a stored solid unit therein which is enclosed by said sealed package and removable in unitary form from said package, and a reclosable cover that is hingedly connected to said base member, wherein in an open position of said cover being spaced from said base member each said package being selectively removable from its respective storage compartment independently of any other said package.

4. A storage device for a shaving razor comprising a base member having at least one storage compartment, and a cover that is hingedly connected to said base member, said cover having a shaving razor engagement structure on an external surface thereof.

5. A wall-mounted storage device comprising a base member having a wall-mounting structure, said base member having at least one storage compartment, and one or more packages that are each located in a respective said compartment, each said package containing a stored unit therein that is removable as a single unit, each said compartment having opposed members providing a retention force to opposite sides of a said package within said compartment.

6. The storage device of claim 2 wherein said base member has a surface-mounting structure.

7. The storage device of claim 2 wherein said base member has a wall mounting structure.

8. The storage device of claim 3 or 5 wherein said stored unit is a shaving cartridge including a plastic housing and a plurality of blades.

9. The storage device of claim 2 wherein said base member is formed of plastic and has a side wall that extends around its periphery.

10. The storage device of claim 9 wherein said base member has a plurality of said compartments and dividers formed therein to provide said compartments along with said side wall, each said divider having a free end and a base portion.

11. The storage device of claim 5 wherein said base member is formed of plastic and has a side wall that extends around its periphery.

12. The storage device of claim 11 wherein said base member has a plurality of said compartments and dividers formed therein to provide said compartments along with said side wall, each said divider having a free end and a base portion.

13. The storage device of claim 10 or 12 wherein said dividers each have a flat portion at said free end of said divider, said flat portion receiving a lip that extends from one side of said package, said divider having a ridge that is formed in said divider between said base portion and said end for receiving a narrow edge portion of said package.

14. The storage device of claim 10 or 12 wherein said dividers each have a flat portion at said free end of said divider, said flat portion receiving a lip that extends from one side of said package, and said dividers extend only part way from said side wall at one side of said base member to the side wall at the other side to provide a region for gripping an exposed portion of said lip.

15. The storage device of claim 12 wherein said dividers have said opposed members thereon.

16. The storage device of claim 5 wherein one said opposed member is resilient.

17. The storage device of claim 5 wherein a said opposed member has a sharp portion that engages said package.

18. The storage device of claim 5 wherein said opposed members provide an interference fit for a respective said package.

19. The storage device of claim 10 or 12 wherein said dividers have drainage openings.

20. The storage device of claim 9 or 11 wherein said side wall has a drainage opening at the bottom of said base member.

21. The storage device of claim 10 or 12 wherein said base member has projections between said dividers to position said packages.

22. The storage device of claim 1 or 3 wherein said base member is formed of plastic, and wherein said base member has a plurality of said compartments and has a plurality of said dividers formed therein to provide said compartments.

23. The storage device of claim 1 further comprising a cover that is hingedly connected to said base member.

24. A shaving cartridge storage device comprising a base member having at least one storage compartment, and one or more sealed packages that are each located in a respective storage compartment, each said sealed package containing a shaving cartridge including a plastic housing and a plurality of blades, further comprising a cover that is hingedly connected to said base member, wherein said cover has a shaving razor engagement structure on an external surface thereof.

25. The storage device of claim 4 or 24 wherein said cover is hingedly connected to said base member by a snap-fit connection.

26. The storage device of claim 4 or 24 wherein said razor engagement structure includes a portion of said cover defining an opening to engage the bottom of a handle of a razor.

27. The storage device of claim 4 or 24 wherein said cover has a raised portion matching the contour of one side of a razor handle.

28. The storage device of claim 4 or 24 wherein said cover has opposed wings to engage a razor handle near the razor head end of the handle.

29. The storage device of claim 4 or 24 wherein said cover has opposed flexible wings to engage a razor handle near the razor head end of the handle, and a support portion between the wings.

30. The storage device of claim 4 or 24 wherein said cover has a flat area to provide clearance for the cartridge attached to a handle supported on said engagement structure.

31. The storage device of claim 4 or 24 wherein said cover is made of softer plastic than said base member.

32. The storage device of claim 3 wherein said base member is formed of plastic and has a side wall that extends around its periphery.

33. The storage device of claim 32 wherein said base member has a plurality of said compartments and said base member has a plurality of said dividers formed therein to provide said compartments along with said side wall.

34. The storage device of claim 2 further comprising a cover that is hingedly connected to said base member.

35. The storage device of claim 34 wherein said cover has a shaving razor engagement structure on an external surface thereof.

36. The storage device of claim 5 wherein said wall mounting structure comprises double-sided adhesive tape.

37. The storage device of claim 5 wherein said wall mounting structure comprises suction cups.

38. The storage device of claim 5 wherein said wall mounting structure comprises portions of said base member defining openings for receiving transverse mounting members attached to a wall.

39. The storage device of claim 3, 4, 23 or 34 wherein said cover has a snap-fit closure member and a finger engagement lip extending from said cover for opening said cover.

40. A wall-mounted storage device comprising a securing device for securely mounting to a wall, said securing device carrying a first engagement structure, and a base member that is removably mounted to said securing device, said base member carrying a second engagement structure that removably engages said first engagement structure, said base member having a plurality of storage compartment and one or more packages that are each located in a respective said compartment, each said package containing a single razor cartridge comprising a plastic housing and one or more blades.

41. The storage device of claim 40 wherein said securing device includes a plate that is adapted to be attached to said wall, and said first engagement structure extends from said plate.

42. The storage device of claim 41 wherein said first engagement structure comprises a post, and said second engagement structure comprises a slotted opening sized to receive said post in one portion of said slotted opening, and securely engage said post with an interference fit in another portion of said slotted opening.

43. The storage device of claim 41 wherein said first engagement structure comprises four posts, and said second engagement structure comprises four slotted openings that are each sized to receive a respective said post in one portion of said slotted opening, and securely engage said respective post with an interference fit in another portion of said slotted opening.

44. The storage device of claim 40 wherein said base member includes a recess, and said securing device includes a locating projection shaped to fit within said recess.

45. The storage device of claim 40 or claim 41 wherein said securing device is shaped to fit within at least one of said plurality of storage compartments of said base member prior to attachment to said wall.

46. A removable wall-mounted storage device for connection to a securing device that is securely mounted to a wall and carries a first engagement structure, said storage device comprising a base member that is removably mountable to said securing device, said base member carrying a second engagement structure that removably engages said first engagement structure, said base member having a plurality of storage compartment, and one or more packages that are each located in a respective said compartment, each said package containing a single razor cartridge comprising a plastic housing and one r more blades.

47. The storage device of claim 46 wherein said first engagement structure comprises a post, and said second engagement structure comprises a slotted opening sized to receive said post.

48. The storage device of claim 46 wherein said first engagement structure comprises four posts, and said second engagement structure comprises four slotted openings that are each sized to receive a respective said post in one portion of said slotted opening, and securely engage said respective post with an interference fit in another portion of said slotted opening.

49. The storage device of claim 1 or 3, wherein said sealed package comprises a container having an opening that has been sealed with a cover sheet, and with said sealed package being received in its storage compartment, the container having article-surrounding lateral sides upstanding from the base member and the container opening directed upwards away from the base member.

50. A shaving cartridge storage device comprising a base member having at least one storage compartment, and one or more sealed packages that are each located in a respective storage compartment, each said sealed package containing a shaving cartridge including a plastic housing and a plurality of blades, wherein said base member has a surface-mounting structure.

51. A storage device for one or more sealed packages comprising a base member having at least one storage compartment, one or more sealed packages that are each located in a respective storage compartment, each said package containing a stored unit therein, and a cover that is hingedly connected to said base member, wherein said base member has a surface-mounting structure.

52. A shaving cartridge storage device comprising a base member having at least one storage compartment, and one or more sealed packages that are each located in a respective storage compartment, each said sealed package containing a shaving cartridge including a plastic housing and a plurality of blades, wherein said base member has a wall-mounting structure.

53. A storage device for one or more sealed packages comprising a base member having at least one storage compartment, one or more sealed packages that are each located in a respective storage compartment, each said package containing a stored unit therein, and a cover that is hingedly connected to said base member, wherein said base member has a wall-mounting structure.

54. The storage device of claim 40 or 46 wherein there are a plurality of said packages.

55. The storage device of claim 40 or 46 wherein said base member has a longitudinal vertical axis, and said compartments have longitudinal axes arranged transverse to said vertical axis of said base member.

56. The storage device of claim 4 wherein each said storage compartment has an opening directed towards an underside of said hinged cover in a closed condition thereof, whereby in a closed condition the cover substantially overlies the opening of the storage compartment.

57. The storage device of claim 5 wherein the base member has a rear wall, a pair of laterally opposed side walls upstanding from the rear wall, and at least one pair of spaced transverse walls upstanding from the rear wall, the pair of opposed side walls and the transverse walls defining the at least one storage compartment, whereby said storage compartment surrounds each said package at opposed lateral faces of the package and defines a withdrawal opening directed away from the rear wall for each said package and is stored unit to be withdrawn together as a unit in a direction generally normal to and away from the rear wall.

* * * * *

UNITED STATES PATENT AND TRADEMARK OFFICE

CERTIFICATE OF CORRECTION

PATENT NO. : 6,415,517 B1
DATED : July 9, 2002
INVENTOR(S) : Charles Bridgham Worrick, III It is certified that error appears in the above-identified patent and that said Letters Patent is hereby corrected as shown below:

Title page,
Item [56], References Cited, U.S. PATENT DOCUMENTS "5,782,346:" remove "7/1998" add -- 6/1998 --; add the following:

| | | | |
|---|---|---|---|
| -- 5,457,887 | 10/1995 | Grange | 30/90 |
| 3,095,965 | 7/1963 | Stahl et al. | 203/16 |
| 2,822,916 | 2/1958 | Wark et al. | |
| D90931 | 10/1933 | Wanders -- | |

Column 8,
Line 27, change "compartment" to -- compartments --
Line 27, add -- , -- after "compartments"

Column 9,
Line 2, remove "r" and add -- or --

Column 10,
Line 40, remove "is" add -- its --

Signed and Sealed this

Thirteenth Day of April, 2004

JON W. DUDAS
*Acting Director of the United States Patent and Trademark Office*